US005208924A

United States Patent [19]

Smith et al.

[11] Patent Number: 5,208,924

[45] Date of Patent: May 11, 1993

[54] DECORATIVE BATHTUB FRONT ENCLOSURE

[75] Inventors: Timothy S. Smith, Indianapolis, Ind.; Mostafa Doroudian, Los Angeles; Howard D. Dirkson, Mission Viejo, both of Calif.

[73] Assignee: Gaylan Industries, Inc., Anaheim, Calif.

[21] Appl. No.: 658,024

[22] Filed: Feb. 19, 1991

Related U.S. Application Data

[63] Continuation-in-part of Ser. No. 474,231, Jan. 19, 1990, abandoned, which is a continuation of Ser. No. 181,819, Apr. 15, 1988, abandoned.

[51] Int. Cl.[5] ..... A47K 3/02; B44F 7/00

[52] U.S. Cl. ..... 4/584; 52/455; 52/311.1

[58] Field of Search ..... 4/546, 548, 549, 584, 4/592, 593, 595; 49/501; 52/311, 312, 314, 474, 238.1, 241, 242, 455, 456; 428/44, 45; D25/138

[56] References Cited

U.S. PATENT DOCUMENTS

| | | | |
|---|---|---|---|
| 651,994 | 6/1900 | Holland | 52/456 |
| 2,269,748 | 1/1942 | Widman | 4/584 |
| 2,427,375 | 9/1947 | Walker et al. | 4/584 |
| 3,028,603 | 4/1962 | Rodman | 4/584 X |
| 3,046,568 | 7/1962 | Holberson | 4/593 |
| 3,299,594 | 1/1967 | Kellert | 52/242 |
| 3,995,402 | 12/1976 | Parenteau | 52/241 |
| 4,067,071 | 1/1978 | Altman et al. | 4/595 X |
| 4,167,088 | 9/1979 | Governale | 49/501 X |
| 4,290,154 | 9/1981 | Benjamin | 4/595 X |

FOREIGN PATENT DOCUMENTS

| | | | |
|---|---|---|---|
| 1011139 | 7/1957 | Fed. Rep. of Germany | 52/455 |
| 1257086 | 2/1961 | France | 4/546 |
| 2926 | 9/1890 | Sweden | 4/584 |
| 578102 | 7/1976 | Switzerland | 52/656 |
| 562587 | 7/1944 | United Kingdom | 4/593 |
| 659239 | 10/1951 | United Kingdom | 4/584 |

*Primary Examiner*—Henry J. Recla
*Assistant Examiner*—Glenn T. Barrett
*Attorney, Agent, or Firm*—Lyon & Lyon

[57] ABSTRACT

A front enclosure for a bathtub including a top rail, a bottom rail, and vertical supports arranged to contain panels which fit in the grooves in the rails and vertical supports. The enclosure may be readily assembled and adjusted to fit and be installed on the front of a bathtub to provide an enhanced appearance. The enclosure attaches to the front of the bathtub without requiring any structural modification of the bathroom or significant disruption of the household.

11 Claims, 7 Drawing Sheets

80
82
84
86
82, 84

FIG. 11.
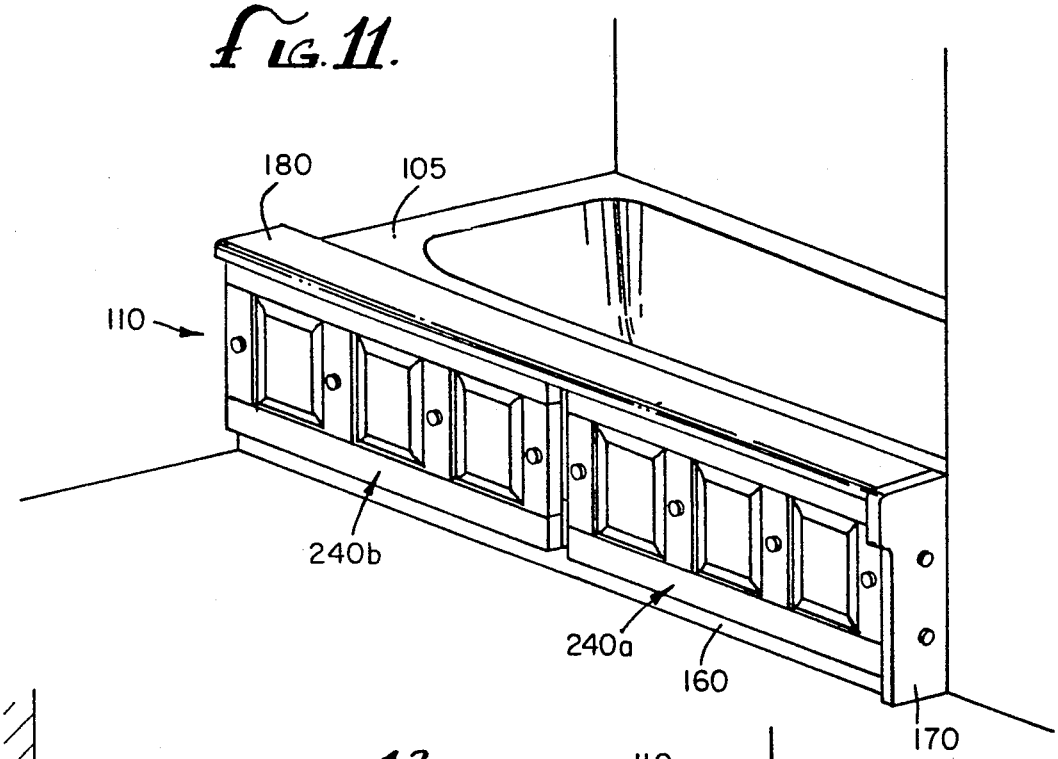
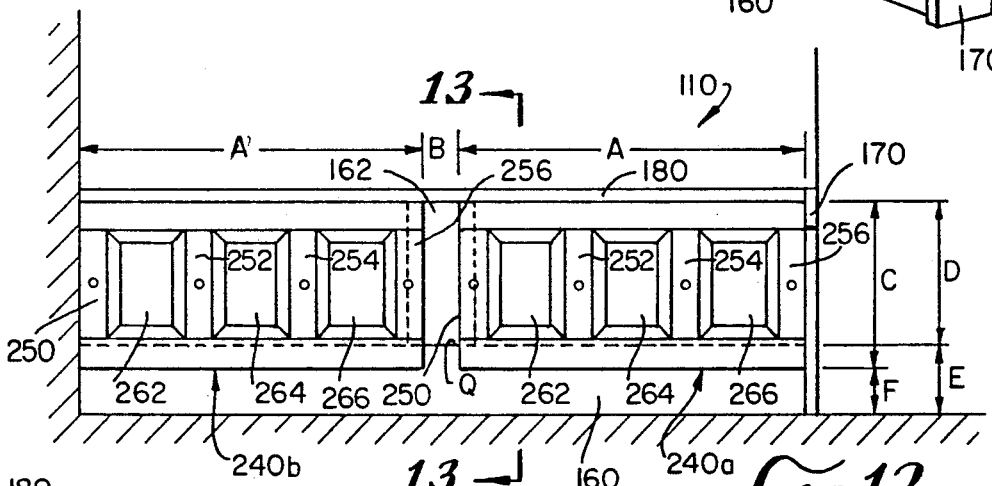
FIG. 12.
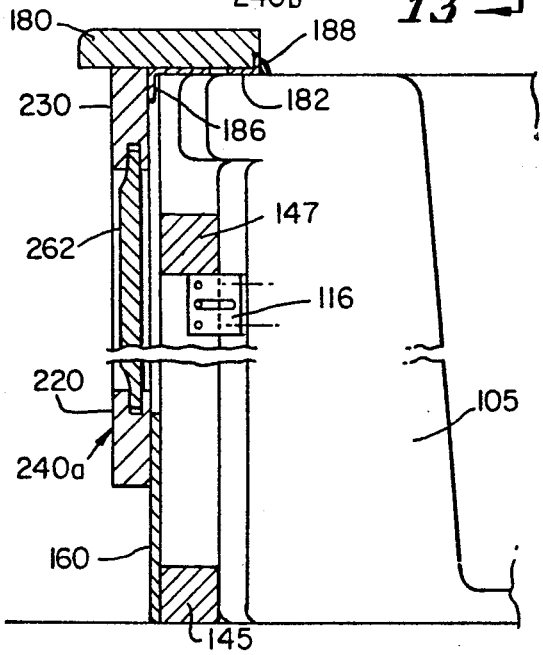
FIG. 13.
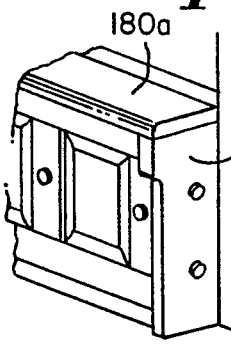
FIG. 17.
FIG. 16.
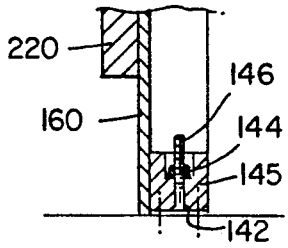

DECORATIVE BATHTUB FRONT ENCLOSURE

This application is a continuation-in-part of application Ser. No. 474,231 filed Jan. 19, 1990 (abandoned) which is a continuation of application Ser. No. 181,819 filed Apr. 15, 1988 (abandoned).

BACKGROUND OF THE INVENTION

The field of the present invention relates to bath fixtures and particularly relates to a front enclosure for a bathtub.

In present day bathrooms and particularly in present day fabricated fixtures where the bathtub is made of fiberglass, the facade of the bathtub provides a very plain appearance. In some instances, particularly in older bathrooms, the appearance of the bathtub may also have deteriorated. In any case, a householder may desire a more decorative look for the front of the bathtub. Generally in order to obtain a desired look, the householder would have to tear out or replace the existing bathtub with a more decorative one, or possible remodel with, for example, decorative tiles. To tear out an existing bathtub and replace it with a new more decorative unit or otherwise remodel can be very expensive and disruptive to the household.

It is therefore desireable to be able to enhance the appearance of a bathtub without tearing out the existing bathtub and inexpensively and easily provide an improved appearance.

SUMMARY OF THE INVENTION

The present invention is directed to a front enclosure for a bathtub and method of installation. The enclosure may be readily assembled and adjusted to fit and be installed on the front of a bathtub to provide an enhanced appearance without requiring any structural modification of the bathroom or significant disruption of the household. The enclosure may include decorative panels which fit in the grooves in the rails and vertical supports.

BRIEF DESCRIPTION OF THE DRAWINGS

FIG. 11 is a perspective view illustrating a preferred bathtub front enclosure;

FIG. 12 is a front plan view of the bathtub front enclosure of FIG. 11;

FIG. 13 is a cross sectional view of the bathtub front enclosure of FIG. 12 taken along line 13—13;

FIG. 16 illustrates an alternate means for securing the enclosure frame to the floor; and FIG. 17 illustrates an alternate sideboard design.

DETAILED DESCRIPTION OF THE PREFERRED EMBODIMENTS

The preferred embodiments of the present invention will now be described with reference to the drawings. For ease of description, any numeral representing an element in one figure will represent the same element in any other figure.

Figure 3:
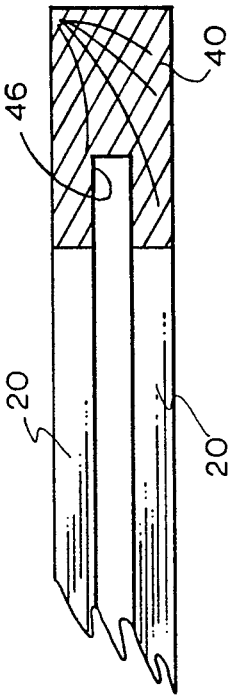
FIG. 3 is a cross-sectional view of FIG. 1 taken along line 3—3.
Figure 2:
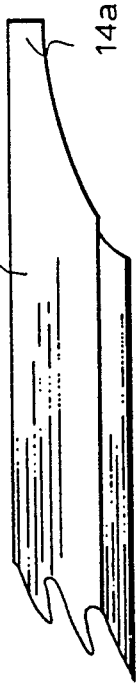
FIG. 2 is a cross sectional view of the panel of FIG. 5 taken along line 2—2.
Figure 1:
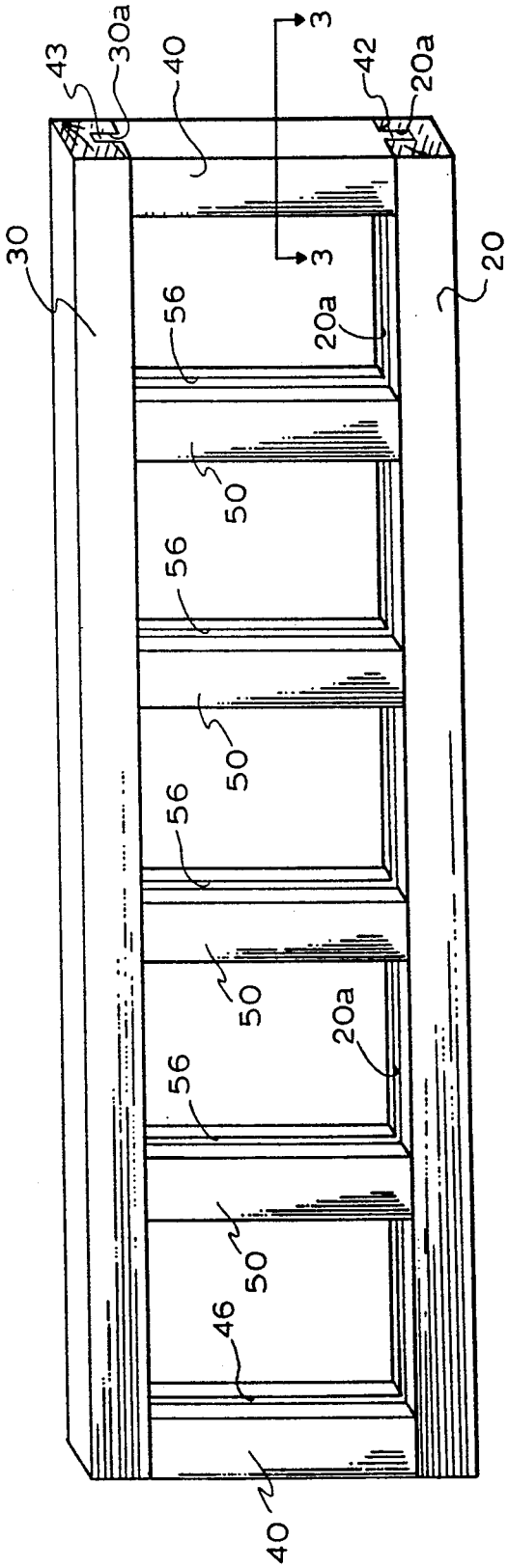
FIG. 1 is a front perspective view of a tub enclosure assembly according to a first embodiment of the present invention.
Figure 6:
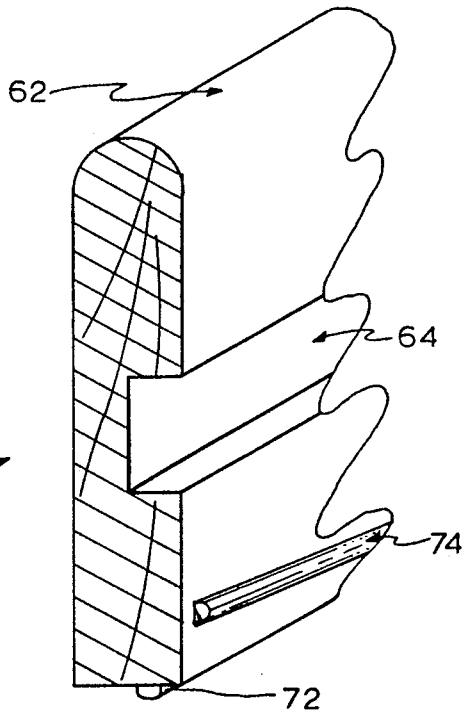
FIG. 6 is a side view in perspective of the top cap.
Figure 5:
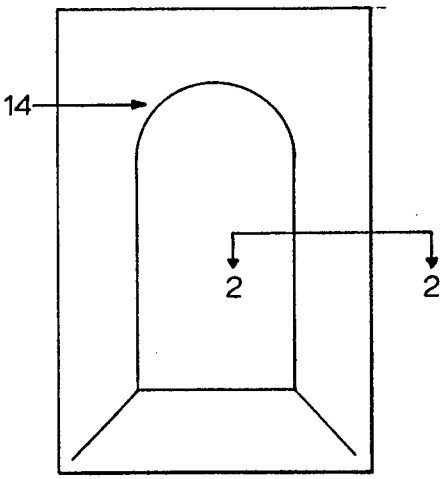
FIG. 5 is a front view of a panel insert.

FIGS. 1-10 illustrate a first embodiment of a bathtub front enclosure assembly. FIG. 1 illustrates a front enclosure assembly 10 in perspective view. The front enclosure assembly 10 is comprised of a bottom rail 20 and a top rail 30 and a plurality of vertical uprights or supports 40 and 50. The top rail 30 and the bottom rail 20 have a rectangular cross section and have a longitudinal groove or keyway 30*a* and 20*a* running lengthwise along one side of the respective rail.

Figure 4:
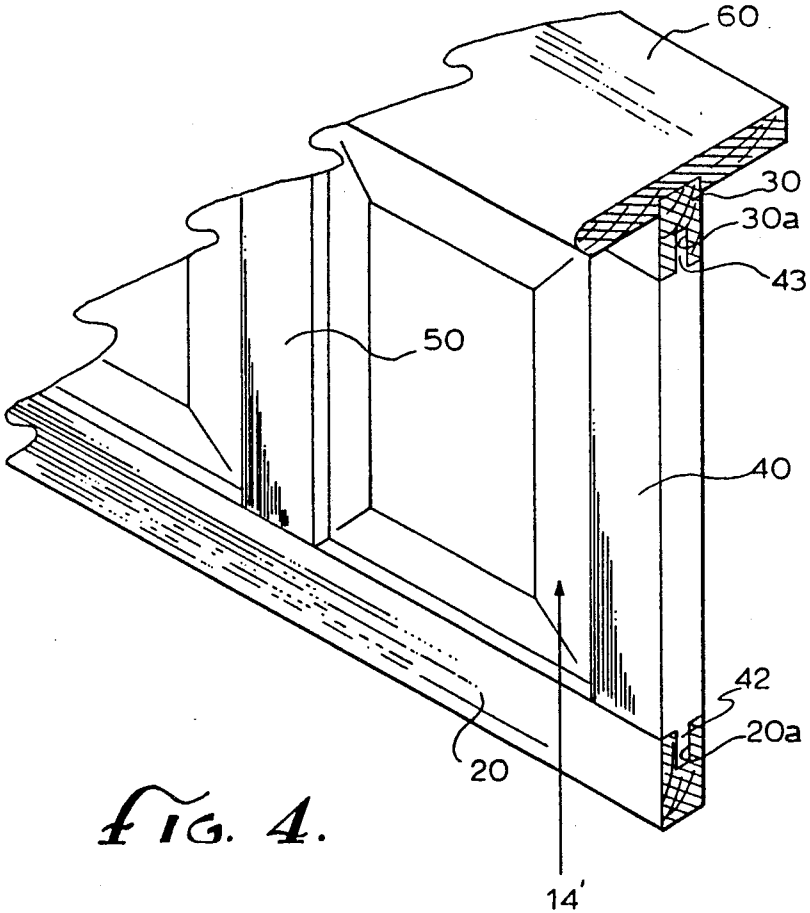
FIG. 4 is a detailed assembled view of a portion of the tub enclosure of FIG. 1 in perspective.
Figure 7:
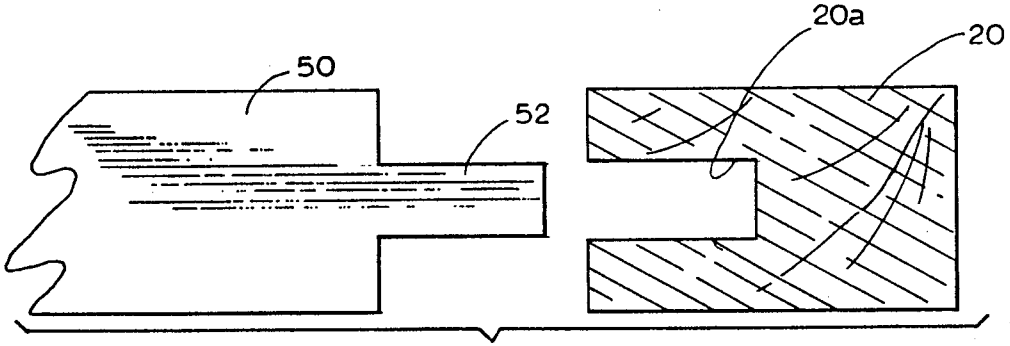
FIG. 7 is an exploded view showing the assembly method for the vertical support and the top rail.

Corresponding to these longitudinal grooves 20*a* and 30*a*, each of the rails 40 and 50 have a tongue or spline on each end thereof. Referring to the splines on the end vertical support 40 as illustrated in FIGS. 1 and 4, the bottom portion of vertical support 40 has a spline 42 which corresponds and fits into the groove or keyway 20*a* within bottom rail 20. Similarly the top portion of the vertical support 40 has a spline 43 which corresponds to and fits into the groove 30*a* in the top rail 30. As illustrated in FIG. 7, the center supports 50 also have corresponding splines 52 which fit into the grooves 20*a* and 30*a* within the bottom and top rails 20 and 30. This spline fit joint provides a secure and easily assembled structure.

The vertical supports 40 and 50 also have a series of longitudinal panel grooves 46 and 56 which run along the inner faces thereof. When assembled on the bottom rail, the longitudinal groove 20*a* on the bottom rail 20 is co-planar with the grooves 46 and 56 in the vertical supports 40 and 50. A panel 14 may then be slid down into the panel grooves 46 and 56 and into the longitudinal groove 20*a* within the bottom rail 20. As viewed in FIGS. 2 and 3, the edge 14*a* of panel 14 readily slides into the groove 46 within the vertical support 40. The top rail 30 may then be aligned with its longitudinal groove 30*a* fitting over the top edge of the panels 14, the splines 43 in end supports 40, and the splines on the top of center supports 50.

To complete the final appearance, a top cap 60 is installed on top of the top rail 30. The top cap 60 has a longitudinal groove 64 along its underside which corresponds in width to the top of top rail 30. The top cap 60 preferably has a rounded or rolled front edge 62. When sealed to the tub frame for example, the top cap 60 prevents water from getting behind the assembly 10.

Figure 3B:
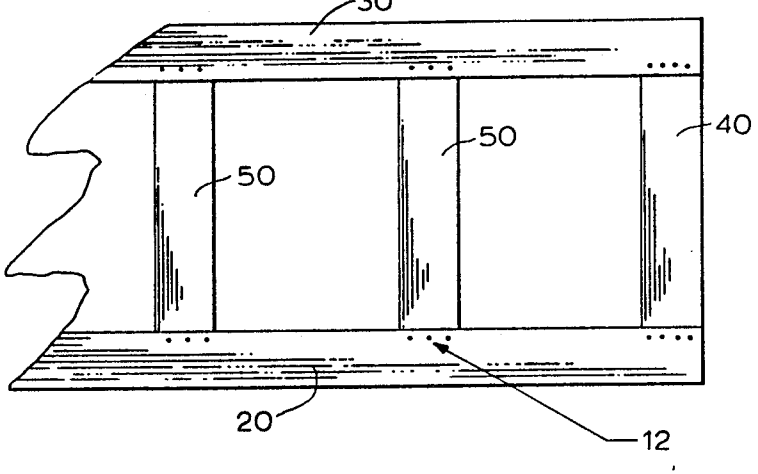
FIG. 3B is a rear elevation view of a portion of the tub enclosure of FIG. 1.

The assembly and installation of the unit will now be described with particular reference to FIG. 4. The two end vertical supports 40 are placed on opposite ends of a bottom rail 20 inserting the splines 42 into the longitudinal groove 20*a*. The vertical supports are oriented so as to have their longitudinal panel grooves facing each other. Next the remaining vertical supports 50 are evenly spaced between the end supports 40 placing the splines 52 within the longitudinal groove 20*a* in bottom rail 20. The panels 14' are then slid down into the panel grooves 46 and 56 between adjacent vertical supports 40 and 50 and into the longitudinal groove 20*a* in bottom rail 20. The top rail 30 is then inserted with its groove 30*a* over the splines 43 in the end vertical supports 40, the splines of the inner vertical supports 50, and the panels 14'. As viewed in FIG. 3B, the vertical supports 40 and 50 may be pin nailed together by nails 12 preferably from the rear or tub side and then glued.

The panels 14 are preferably neither nailed nor glued in place. In fact the panel is of a thickness to allow a spacing of 1/16th of an inch between the panel and the support grooves around its entire circumference. This space is needed to allow the panel to breathe or move slightly in a case where swelling of such a wooden panel may occur. Therefore when assembling the unit using glue, all the supports and rails must be glued together at the spline joints without allowing the glue to reach the panels so that the panels may breath and move.

This freedom of movement of the panels is very important to the durability and long life of the enclosure. If the panels are glued or nailed in place, damage may readily result. As the wood becomes wet, which is inevitable within the bathroom environment, the wood will swell and upon drying may crack or bow. The freedom of movement allowed by this unique panel groove mounting design permits a freedom of movement avoids splitting or bowing due to swelling of the wood.

The panel design is also preferred for reducing cost of manufacture, ease of manufacture, and versatility. The same general frame design of rails and vertical supports may be coupled with panels of various design (such as the cathedral style panel in FIG. 5 or the alternate design panel 14' in FIG. 4) which are interchangeable within a particular frame unit 10. Only one design of the frame 10 is therefore required and a large variety of various panels 14 can be separately manufactured and then assembled to match varying decor within a bathroom. Such interchangeability enhances product versatility and reduces manufacturing cost.

Typically the unit will be sold partially assembled with the frame unit 10 completely assembled with the top cap 60 separate. The standard bathtub is approximately 60 inches in length. Correspondingly, the frame unit 10 is preferably about 58 inches in length with the top cap being about 62 inches to allow the unit to be installed on a range of bathtub sizes. Therefore the top cap 60 may then be trimmed to fit the particular gap between the walls along the length of the bathtub. The space between the walls along the length of the bathtub can vary because of the varying size of the particular bathtub as well as varying thicknesses of drywall, wall tiles or the like.

Figure 9:
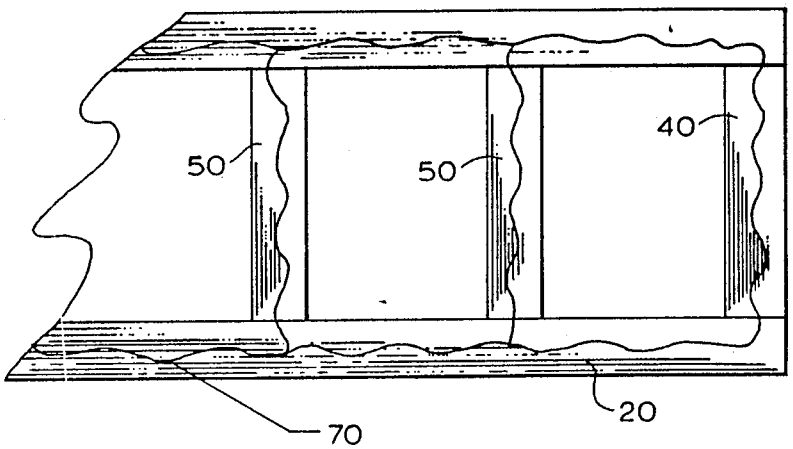
FIG. 9 is a rear side elevation view of a portion of the tub enclosure of FIG. 1 illustrating the position for sealing application.

To install the assembled unit 10, a bead of an adhesive 70 such as silicone rubber is applied to the backside of the top and bottom rails 20 and 30 and the vertical supports 40 and 50 as shown in FIG. 9. The assembled units 10 is then applied to the side of the bathtub with the adhesive 70 securing the unit 10 thereto. As viewed in FIG. 6, a bead of silicon rubber 72 is applied to the back end of the top cap 60 and another bead of silicon rubber is applied along the bottom surface of the top cap 60. Though not shown, a sealing material is normally applied within the groove 64 in the top cap 60 and then the top cap 60 is placed on the top rail 30. The top cap 60 then adheres to the top rail 30 in the groove 64, to the door at the back end along bead 72, and to the top of the tub along the bead 74. Trim may be added to cover gaps between the end supports 40 and the wall.

Figures 8A, 8B, 8C, 8D, 8E:
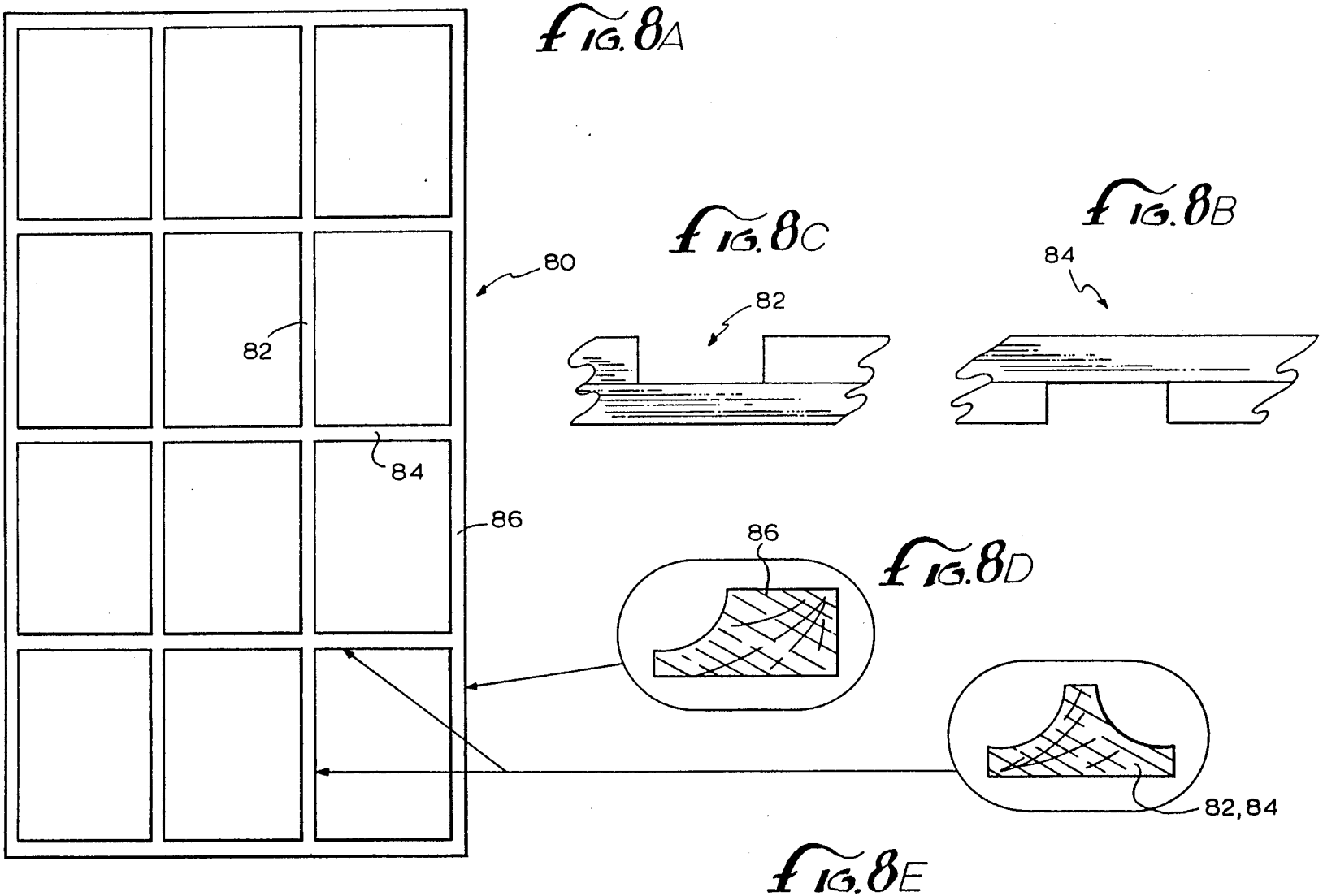
FIGS. 8A, 8B, 8C, 8D, and 8E illustrate decorative door inserts.
Figure 10:
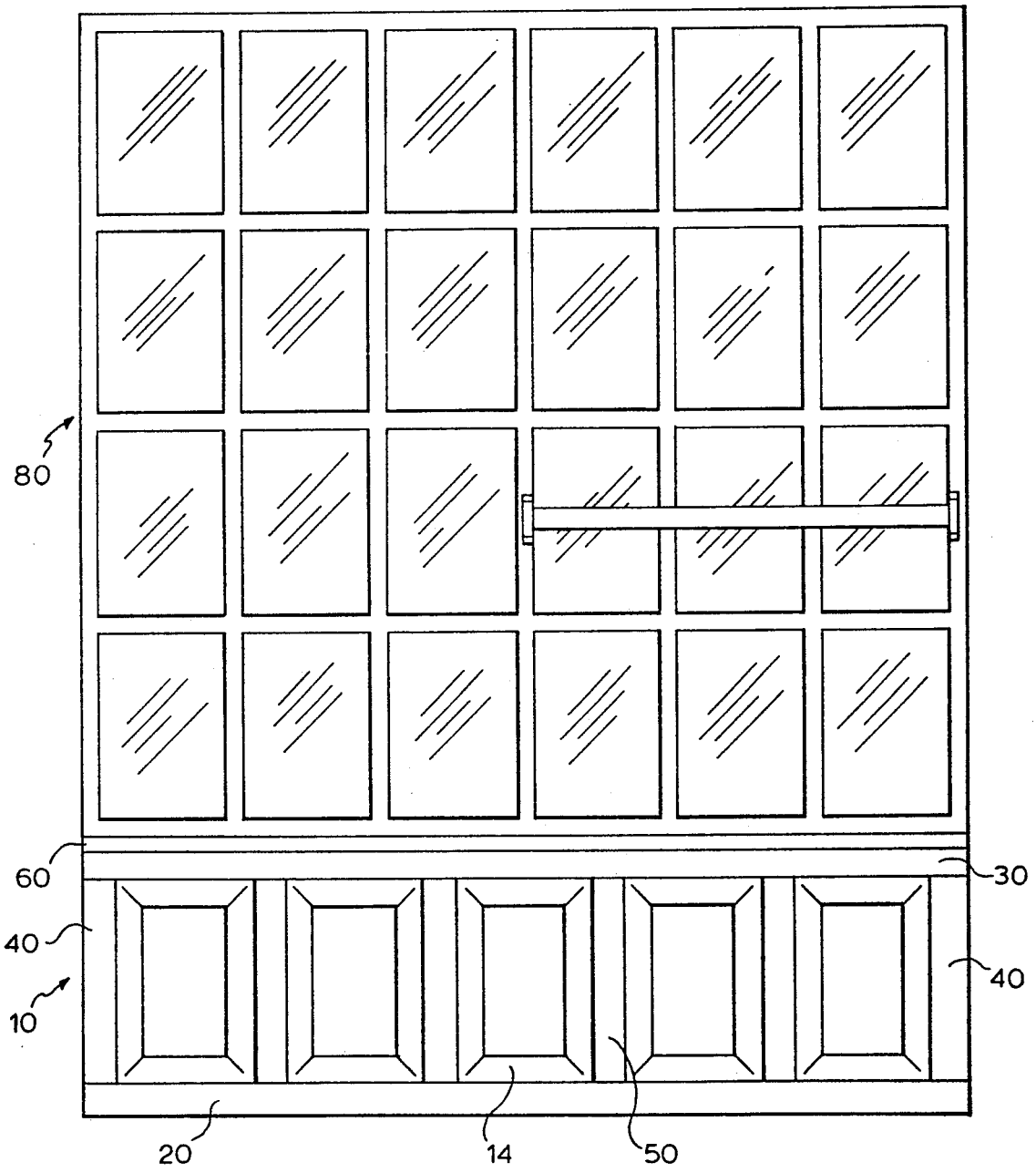
FIG. 10 is a front view showing a complete bathtub front enclosure with matching door inserts.

FIGS. 8A through 8E illustrate matching trim which can be installed on the shower doors to provide a complete appearance for the bathtub. The trim 80 is comprised of a grid of vertical slats or molding 82 and horizontal slats 84. The slats intersect such that at the intersection, slats 82 and 84 form a joint as shown in FIGS. 8B and 8C. The outside railing as illustrated in FIG. 8D has a single bevel on one side thereof while the inner slats 82, 84 have a bevel on both sides as shown in FIG. 8E. As shown in FIG. 10, the overall appearance of the shower doors with the panel look provides a matching and desireable bathroom appearance.

Though the embodiment illustrated in FIGS. 1–10 shows an assembly 10 with five panels 14, the unit may be readily designed with other numbers of panels. A single panel design would then have only end supports 40 and no central support 50.

The second embodiment of the present invention is illustrated in FIGS. 11–15. Though the above described first embodiment accomplishes its intended purpose, the second embodiment is the preferred design. Referring to FIGS. 11 and 12, a tub enclosure 110 is shown installed on a bathtub 105. The preferred bathtub front enclosure 110 may be readily installed on the front of an existing bathtub with a minimum of installation steps. Bathtubs and bathroom designs are not constructed to standard dimensions and it is desirable that the front bathtub enclosure include adjustable features for convenient installation thereof.

The enclosure 110 includes a top panel 180, a side panel or sideboard 170, right and left panel sections 240*a* and 240*b*, a baseboard or floor board 160, a top panel 180, and centerboard 162. The left and right panel sections 240*a* and 240*b* are preassembled having with dimensions "A" as illustrated in FIG. 12. The gap "B" between the left and right panel sections 240*a* and 240*b* is variable depending upon the overall dimension of the tub upon which the enclosure 110 is being installed. Though the illustrated embodiment is shown having an open wall on the right side, the sideboard 170 may be located on the left side of the enclosure 110. The enclosure 110 may also be installed between two walls as there is no open wall on one side in which case the sideboard 170 would not be used. Of course if the tub 105 is located in the center of a wall, sideboards 170 may be positioned on either side thereof.

When being assembled, the left and right panel sections to 240*a* and 240*b* overlap the centerboard 162 so that no modification is required to the panel sections 240*a* and 240*b*. The top panel 180 and the bottom panel 160 are the only components which need to be cut to fit by the installer in order to adjust to the length of the bathtub 105. Similarly, the height of the enclosure 110 is readily adjustable. The floor panel 160 is placed along the bottom of the tub 105 and the center panel 162 placed against the floor panel 160. The center panel 162 is then measured and the cut to fit a dimension "D" for the particular height of the bathtub 105. The height "E" of the floor panel 160 is greater than the gap "F" below left and right panel sections 240*a* and 240*b*. The left and right panel sections 240*a* and 240*b* Will abut against the top panel 180 and depending upon the overall height of the tub 105, the amount of the panel sections will overlap the floor panel 160 thereby varying the gap "F" of the bottom of the panel sections to the floor. The height "C" of left and right panel sections 240*a* and 240*b* needs to be less the overall height of the tub 105.

These adjustment features not only permit ready assembly of the enclosure 110, but also permit a single unit to be manufactured which can be custom fit to a large variety of bathtub size and installations. Limitations are that the length or width of the bathtub cannot be less than the combined wedge of the panel sections 240*a* and 240*b* (i.e. 2×"A") and the overall length mentioned cannot exceed the combined lengths of the panel sections 240*a* and 240*b* plus the width of the center panel 162 (some overlap between the center panel 162 and left and right panel sections 240*a* and 240*b* should be preserved. Similarly, the maximum height permitted by the above combination is the height of the panel sections "C" plus the height of the floor board 160 (again permitting for some desired overlap). The minimum height would be the height "C" of the panel sections 240*a* and 240*b*.

The height of the sideboard 170 may also be adjusted by measuring and making a cut on the bottom end thereof to produce the desired height for the element.

Details of construction will now be provided with reference to FIG. 12–15. The enclosure has a support structure comprised of a pair of right and left frame elements 140*a* and 140*b* which are preassembled and essentially identical in construction. The frame elements 140*a* and *b* are each comprised of a lattice structure having a bottom rail 145 and a top rail 147 position parallel thereto. A plurality of vertical supports 150, 152, 154 and 156 are attached between the top and bottom rails 145, 147 to form the desired rectangular support structure.

The support frames 140*a* and 140*b* are preferably constructed from a pine wood or other wood which is more resistant to moisture.

A number of shims or spacer pads 162*a*, 164*a*, 166*a* are placed at the top intersections of the columns 152, 154, 156 and the top rail 147 of the right frame element 140*a*. Similarly, spacer shims 162*b*, 164*b*, and 166*b* are placed at the intersections of columns 150, 152, 154 and the top support 147 of the left frame element 140*b*.

Angle support brackets 112, 114, 116, and 118 are secured to the side of the bathtub 105 by epoxy or some other attachment means. As shown in FIG. 13, the bracket 116 extends outward from the bathtub 105 and has a slotted portion 116*a* through which an attachment screw may be placed and secured to the support column 150. Since many bathtubs have rounded faces, the slot 116*a* in the angle bracket 116 allows the frame portions 140*a* and 140*b* to be aligned in a single plane. The brackets 112, 114, 116, and 118, secure the frame portions 140*a* and 140*b* against the tub, however the primary support is accomplished by the frame portions 140*a* and 140*b* resting on the floor. The left frame portion 140*b* is placed in a position abutting the left side wall and the right frame portion 140*a* is positioned in line with the right side wall thereby adjusting the gap between the frame portions of 140*a* and 140*b* to accommodate different length bathtubs.

Once the frame portions 140*a* and 140*b* are in place, the baseboard 160 may be measured and cut so as to have the proper length. The baseboard 160 is positioned against the bottom rails 145 and may be optionally secured there to. The center board 162 is then placed over the baseboard 160, measured and cut to size between the top surface of the bathtub 105 and the top of the footboard 160. The thickness of the centerboard 162, the footboard 160 and the shims 162*a* and 164 *a* and *b*, and 166 *a* and *b*, are all the same to provide a constant spacing from the frame portions 140*a* and 140*b* forming a planar surface to which the panel sections 240*a* and 240*b* may be attached.

Once the footboard 160 and center board 162 are in place, the front panel sections 240*a* and 240*b* are placed up against frame section with the left panel section 240*b* abutting the sidewall and the right panel section 240*a* aligned with the right wall. The panel sections 240*a* and 240*b* are raised up off the floor so that the top surface of the top rails 230 are aligned with the top of the bathtub 105.

The panel sections 240*a* and 240*b* are then secured to the frame portions by screws 244 passing through preset holes 246. These screws 244 are recessed within the holes 246 and an end cap 242 is install into the hole 246 to provide a finished look. The panel sections 240*a* and 240*b* are comprised of a rectangular framework having a top rail 230 and a bottom rail 220 with the plurality of vertical supports 250, 252, 254, and 256 forming three openings for panels 262, 264, and 266.

FIG. 13 illustrates details of the panel construction where the panel 262 is installed within grooves formed in the top rail 230, the bottom rail 220 and though not shown, corresponding grooves within vertical supports 250 and 252. Further details of the panel installation was described in the above with respect to the previous embodiment. The panels 262, and 264, and 266 are installed in grooves provided with a spacing of approximately 1/16th of an inch between the panel and the support groves around its entire circumference. This spacing is provided to allow the panel to breath or move slightly in the case where swelling of such a wooden panel would occur.

The top rail 180 is provided with a metal angle piece 182 installed at its rear edge along its length, the angle piece 182 being recessed into the rear edge of the rail 180. As best viewed in FIG. 13, the top rail 180 when placed on top of the bathtub 105 does not contact the bathtub 105. All the contact is provided through the metal angle piece 182. Angle sections 184 and 186 are provided and attached to the rear portion of the top panel rails 230 and then secured to the top rail 180. The top rail 180 is then installed upon the panel sections 240*a* and 240*b*.

Before the panel sections 240*a* and 240*b* are attached to the frame sections, in the top rail 180 as previously described must be cut to size as does the angle section 182. Once installed, a bead of caulking 188 may be placed along the interface between the bathtub 105 and the angle piece 182 to seal off the unit from water. The entire enclosure is primarily supported by gravity pressing down upon the bottom rail 145 of the frame sections 140*a* and 140*b*. Two sided foam tape may be applied along the bottom of the bottom rails 145 to secure the frame to the floor and prevent sliding movement away from the bathtub 105. Though the caulking 188 will provide some securement of the top rail 180 to the bathtub 105, two sided tape could also be applied at that location. Other securing mechanisms may be provided to improve the structural soundness of the unit. FIG. 16 illustrates an alternate embodiment where a bottom metal plate 142 having a protruding bolt portion 146 is installed through holes in the bottom rail 145. The plate 142 may be screwed, nailed, epoxied, or otherwise attached to the floor with a nut 144 securing the bottom rail 145.

Figure 14:
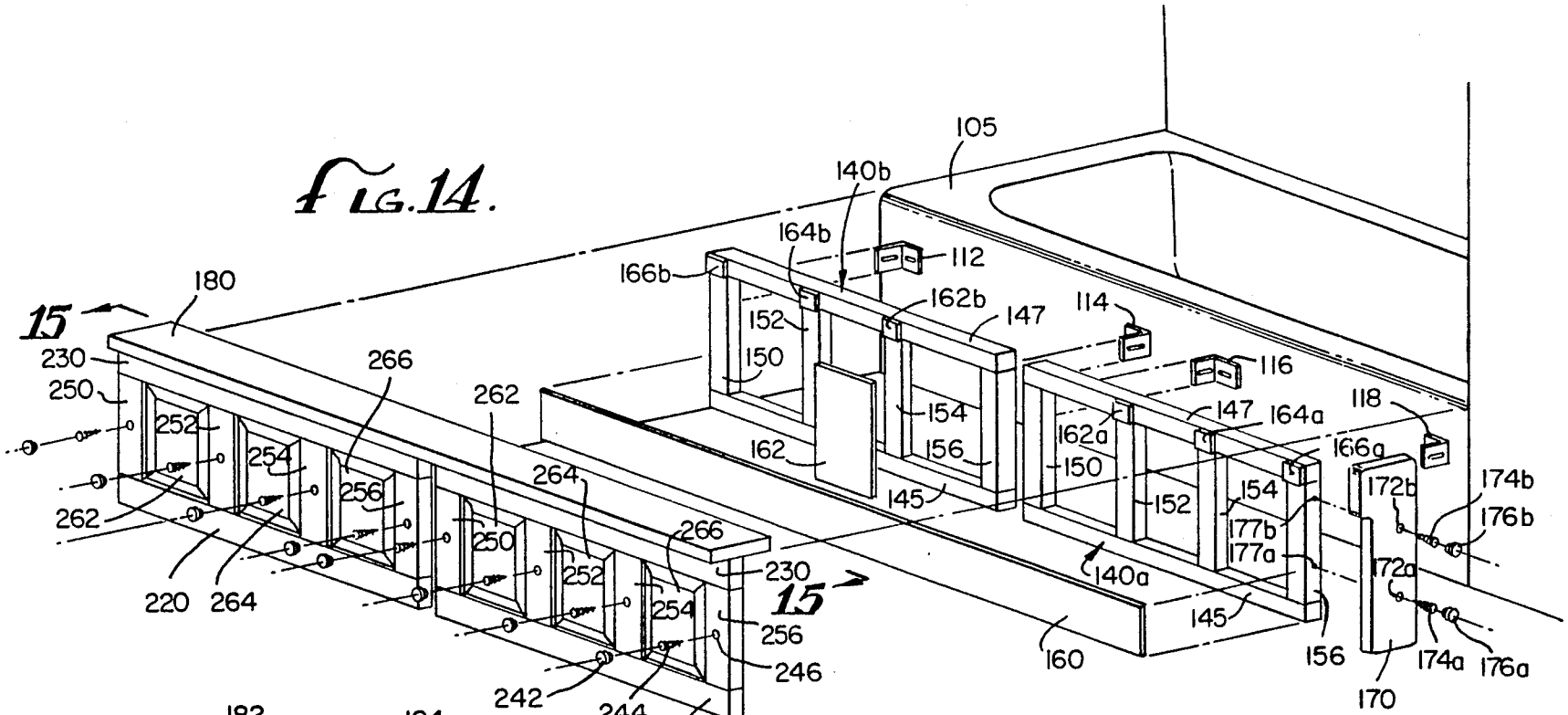
FIG. 14 is a exploded view of the bathtub front enclosure of FIG. 11.
Figure 15:
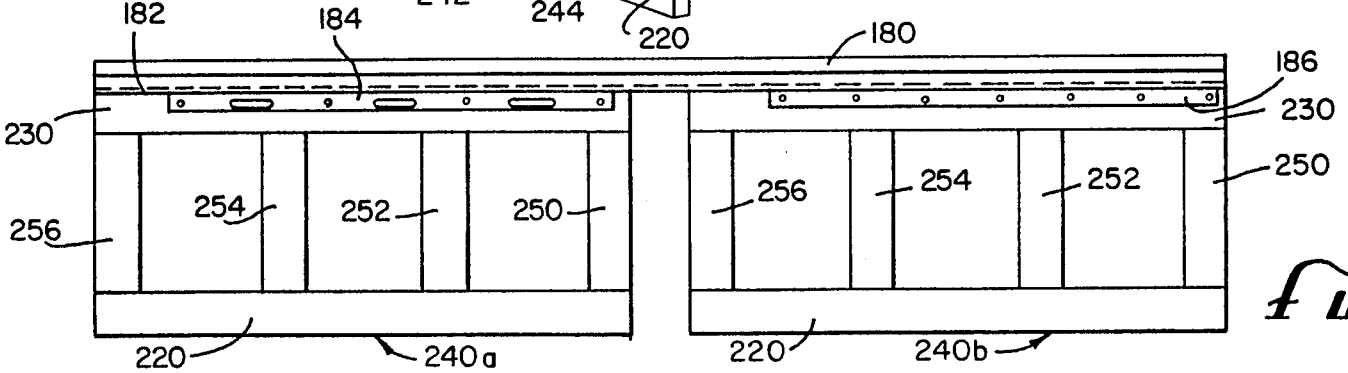
FIG. 15 is a rear plan view of the front panels of FIG. 14 taken along the line 15—15.

Once installed, a sideboard 170 may be installed on either side which has an open wall. FIG. 14 illustrates a configuration with an open side wall on the right side. In any case, the side panel 170 is secured to the side support column 156 by screws 174*a* and 174*b*. The side panel has precut holes 172*a* and 172*b* which allow for the screws 174*a* and 174*b* to be recessed when secured to the support column 156. In actual construction, guide holes 177*a* and 177*b* may be set within the support column 156. Caps 176*a* and 176*b* are then placed in the holes 172*a* and 172*b* to provided the finished look. It has already been described that the side panel 170 is cut along the bottom to adjust its height to a particular bathtub 105.

FIG. 17 illustrates an alternate preferred construction for the sideboard. In FIG. 17, the sideboard 170*a* is cut to size below the top panel 180*a*. In such a construction, the length of the top panel 180*a* would be shorter than the top panel 180 of FIG. 13, the amount being the thickness of the sideboard 170*a*. In such an embodiment, the end of the top panel 180*a* which will end up abutting the wall (for example the left side if arranged as in FIG. 13) is the one which will be cut to fit during the installation. During manufacture, both ends of the top panel 180*a* will be treated to a finished look since one end may be exposed when installed.

The preferred material of construction for the boards and panels is wood with a hardwood such as oak being the material of choice to match other popular oak fixtures in today's bathrooms. Other suitable materials include fiberglass and plastic or even ceramics. A wood such as oak would require a specially treated or waterproofed finish to withstand the water which would inevitably be subjected to the assembly. Despite its susceptibility to water damage, wood is still a desireable material of construction because it is easily handled and cut by the person installing the unit and provides a desired appearance.

Thus a front enclosure for a bathtub has been shown and described. Though certain advantages and embodiments of the present invention have been described, many more modifications would be obvious to those skilled in the art. The invention therefore is not to be limited except in the spirit of the claims to follow.

I claim:

1. A front enclosure for a bathtub, comprising a first frame section and a second frame section coplanarly positionable end to end on a floor against a front face of a bathtub with a gap between the first and second frame sections being adjustable to permit alignment of a first side of the first frame section with a first side edge of the bathtub and alignment of a first side of the second frame section with a second side edge of the bathtub;

a first panel section and a second panel section, each panel section being comprised of:

a bottom rail having a top surface and a bottom surface with a longitudinal groove centered along the top surface thereof, a top rail having a top surface and a bottom surface with a longitudinal groove centered along the bottom surface thereof, two vertical end supports each connected at opposite ends to the top and bottom rails thereby forming a rectangular shape for the panel section, wherein said vertical end supports each have a longitudinal groove along an inside surface thereof, the longitudinal grooves on said supports and said rails being co-planar, an insert panel installed between adjacent vertical supports within the grooves;

a foot board secured lengthwise along the floor to the first and second frame sections;

a center board extending from a top surface of the foot board to a top surface, wherein the center board bridges the gap between the first and second frame sections; and spacer shims attached to the first and second frame sections, the spacer shims having the same thickness as both the floor board and the center board, thereby forming a planar surface, wherein the first and second panel sections are positionable end to end along said planar surface and attached to the first and second frame sections with a gap between the first and second panel sections being adjustable to permit alignment of a first side of the first panel section with the first side edge of the bathtub and alignment of a first side of the second panel section with the second side edge of the bathtub;

a top board attached along a top surface of the bathtub and the top of the first and second panel sections, wherein the foot board is constructed and arranged to cover a gap between the panel sections and the floor and wherein the center board is constructed and arranged to cover a gap between the first and second panel sections.

2. A front enclosure for a bathtub according to claim 1 wherein each of the frame sections has a rectangular shape with a length of significantly less than half the length of an average size bathtub.

3. A front enclosure for a bathtub according to claim 1 wherein said first and second frame sections are secured to the bathtub.

4. A front enclosure for a bathtub according to claim 1 wherein said first and second frame sections are secured to the bathtub by a plurality of angle pieces, each angle piece having a pair of legs and an outer surface of one leg attached to the front face of the bathtub and the other leg extending outward therefrom, the outward leg of the angle having a slot through which a screw, bolt or the like may be used for attachment to a frame section.

5. A front enclosure for a bathtub according to claim 1 wherein said first and second frame sections are comprised of top and bottom rails and the bottom rails are secured to the floor.

6. A front enclosure for a bathtub according to claim 5 wherein the bottom rails of the first and second frame sections are secured to the floor by two-sided tape.

7. A front enclosure for a bathtub according to claim 5 wherein each insert panel is installed within its respective grooves in a floating arrangement without being glued, nailed or otherwise secured in place.

8. A front enclosure for a bathtub according to claim 1, wherein each panel section is further comprised of n central vertical supports, where "n" is an integer $\geqq 1$, each central vertical support being parallel to and spaced between the end vertical supports and connected at opposite ends to the top and bottom rails, wherein each central vertical support has two vertical grooves positioned on opposite sides thereof, the longitudinal grooves on said central and end vertical supports and said rails being coplanar, and n+1 insert panels, each insert panel being installed between adjacent vertical supports within the grooves.

9. A front enclosure such as for a bathtub, comprising a first frame section and a second frame section coplanarly positionable end to end on a floor against a front face of a bathtub with a gap between the first and second frame sections being adjustable to permit alignment of a first side of the first frame section with a first side edge of the bathtub and alignment of a first side of the second frame section with a second side edge of the bathtub;

a first panel section and a second panel section;

a foot board secured lengthwise along the floor to the first frame section;

a center board positioned between the first and second frame sections; and spacer shims attached to the first and second frame sections, the spacer shims having the same thickness as both the floor board and the center board, thereby forming a planar surface, wherein the first and second panel sections are positionable end to end along said planar surface and attached to the first and second frame sections with a gap between the first and second panel sections being adjustable to permit alignment of a first side of the first panel section with the first side edge of the bathtub and alignment of a first side of the second panel section with the second side edge of the bathtub;

a top board attached along a top surface of the bathtub and the top of the first and second panel sections, wherein the foot board is constructed and arranged to cover a gap between the first panel section and the floor and wherein the center board is constructed and arranged to cover a gap between the first and second panel sections.

10. A method of installing a front enclosure on a bathtub comprising the steps of positioning a first rectangular frame section on a floor in front of and against a front of the bathtub and aligning a first side of the frame section along a first side edge of the bathtub;

positioning a second rectangular frame section on the floor in front of and against the front of the bathtub and aligning a first side of the frame section along a second side edge of the bathtub;

arranging the first and second frame sections in a single plane along the front of the bathtub and securing the first and second frame sections in front of the bathtub;

cutting down the length of a floor board having a rear surface and opposed side edges to fit between the first side of the first frame section and a second side of the second frame section;

positioning the floor board lengthwise along the floor with its rear surface abutting against the frame sections and with its opposed side edges aligning with the first and second side edges of the bathtub;

cutting down the length of a center board having a rear surface and opposed side edges to fit between a top edge of the floor board and the top edge of the bathtub;

positioning the center board vertically with its rear surface abutting against the frame sections and centered therebetween and with one side edge abutting the top edge of the floor board and the other side edge aligned with the top edge of the bathtub;

installing spacer shims on the first and second frame sections, the spacer shims having the same thickness as both the floor board and the center board, thereby forming a planar surface;

positioning a first rectangular panel section against the planar surface and aligning a first side of the first panel section along the first side edge of the bathtub and securing the first panel section to the first frame section;

positioning a second rectangular panel section against the planar surface and aligning a first side of the first panel section along the second side edge of the bathtub and securing the second panel section to the second frame section;

cutting down the length of a top board to fit between the first side of the first frame section and a second side of the second frame section;

positioning the floor board lengthwise along the floor with its rear surface abutting against the frame sections and with its side edges aligning with the first and second side edges of the bathtub; and positioning a top board over the top surface of the panel sections and at least a portion of the top surface of the front face of the bathtub, and securing the top board thereto.

11. A front enclosure according to claim 9 wherein the foot board extends from the first side edge of the bathtub to the second side edge of the bathtub.

* * * * *